US010315733B2

(12) United States Patent
Zijderveld et al.

(10) Patent No.: US 10,315,733 B2
(45) Date of Patent: Jun. 11, 2019

(54) MONOHULL DRILLSHIP

(71) Applicant: GustoMSC Resources B.V., Schiedam (NL)

(72) Inventors: Govert Hendrik Teunis Zijderveld, Schiedam (NL); Sjoerd Maarten Hendriks, Schiedam (NL); Willem Johannes Alain Wassink, Schiedam (NL)

(73) Assignee: GustoMSC Resources B.V., Schierdam (NL)

( * ) Notice: Subject to any disclaimer, the term of this patent is extended or adjusted under 35 U.S.C. 154(b) by 0 days.

(21) Appl. No.: 15/556,224

(22) PCT Filed: Mar. 7, 2016

(86) PCT No.: PCT/NL2016/050155

§ 371 (c)(1),
(2) Date: Sep. 6, 2017

(87) PCT Pub. No.: WO2016/144165

PCT Pub. Date: Sep. 15, 2016

(65) Prior Publication Data

US 2018/0043972 A1 Feb. 15, 2018

(30) Foreign Application Priority Data

Mar. 6, 2015 (NL) ..... 2014407

(51) Int. Cl.
*B63B 35/44* (2006.01)
*E21B 19/00* (2006.01)
(Continued)

(52) U.S. Cl.
CPC ..... *B63B 35/4413* (2013.01); *E21B 15/02* (2013.01); *E21B 19/002* (2013.01); *B63B 2003/147* (2013.01)

(58) Field of Classification Search
CPC ..... B63B 35/4413; B63B 2003/147; E21B 21/15; E21B 15/02
(Continued)

(56) References Cited

U.S. PATENT DOCUMENTS 3,628,336 A * 12/1971 Moore ..... E02B 17/021 405/196
4,646,672 A * 3/1987 Bennett ..... B63B 35/4413 114/264
(Continued)

FOREIGN PATENT DOCUMENTS

CN 102092465 A 6/2011
CN 103847932 A 6/2014
(Continued)

OTHER PUBLICATIONS

International Search Report PCT/NL2016/050155 dated Jul. 1, 2016.
(Continued)

*Primary Examiner* — S. Joseph Morano
*Assistant Examiner* — Jovon E Hayes
(74) *Attorney, Agent, or Firm* — Pillsbury Winthrop Shaw Pittman, LLP

(57) ABSTRACT

The invention relates to a monohull drillship (1), comprising an elongated hull (2) extending in the length direction (3) of the drillship. Said hull (2) is provided with at least one open moon pool (4) arranged to be located at the waterline (5) during use of the drillship. The drillship (1) is arranged for multiple-activity operations, e.g. simultaneous drilling and casing handling, in such a manner that drilling equipment can be passed through said at least one moon pool (4) at at least two locations (7, 8), i.e. at at least two so-called well centers, which are spaced apart from each other in at least a
(Continued)

direction (6) substantially transverse to the length direction (3) of the hull of the drillship.

15 Claims, 2 Drawing Sheets

(51) Int. Cl.
*E21B 15/02* (2006.01)
*B63B 3/14* (2006.01)

(58) Field of Classification Search
USPC ..... 114/65 R
See application file for complete search history.

(56) References Cited

U.S. PATENT DOCUMENTS 5,181,798 A * 1/1993 Gilchrist, Jr. ..... F16L 1/225 405/156
6,056,071 A * 5/2000 Scott ..... B63B 35/4413 175/5
6,068,069 A * 5/2000 Scott ..... B63B 35/4413 175/5
6,085,851 A 7/2000 Scott et al.
7,628,224 B2 * 12/2009 D'Souza ..... B63B 35/44 114/144 B
8,256,520 B2 * 9/2012 Lucas ..... B63B 35/4413 166/352
8,925,647 B2 * 1/2015 Humphreys ..... E21B 15/02 166/358
2008/0267716 A1 * 10/2008 D'Souza ..... B63B 35/44 405/203
2011/0017511 A1 * 1/2011 Payne ..... E21B 7/12 175/7
2014/0196948 A1 * 7/2014 Kannegaard ..... E21B 19/143 175/5
2018/0043972 A1 * 2/2018 Zijderveld ..... B63B 35/4413

FOREIGN PATENT DOCUMENTS

CN 104326065 A 2/2015
KR 10-2013-0076919 A 7/2013
KR 10-1480710 B1 1/2015
KR 10-2015-0031955 A 3/2015
WO 2009/102196 A2 8/2009

OTHER PUBLICATIONS

Office Action, corresponding Chinese Patent Application No. 201680014075.2, dated Sep. 5, 2018 with English translation, total 9 pages.
Office Action, corresponding Netherlands Patent Application No. 2014407, dated Apr. 12, 2015, total 14 pages.
Search Report, corresponding Singapore Application No. 11201707243T, dated Jun. 27, 2018, total 2 pages.
Notice of Eligibility for Grant, corresponding Singapore Application No. 11201707243T, dated Jul. 19, 2018, total of 9 pages.
International Search Report & Written Opinion of the International Searching Authority, corresponding PCT Application PCT/NL2016/050155, dated Jul. 1, 2016, total of 13 pages.
Riian Van 'T Veer "Application of Linearized Morison Load in Pipe Lay Stinger Design", Proceedings of the ASME 27th International Conference on Offshore Mechanics and Arctic Engineering, OMAE2008, Jun. 15-20, 2008, pp. 1-10.
Third part Observation Document, submitted in corresponding PCT Application PCT/NL2016/050155, dated Nov. 1, 2016, total of 5 pages.

* cited by examiner

MONOHULL DRILLSHIP

CROSS-REFERENCE TO RELATED APPLICATIONS

This is the U.S. National Stage of PCT/NL2016/050155, filed Mar. 7, 2016, which claims priority to Netherlands Application No, 2014407, filed Mar. 6, 2015, the contents of each of these applications being incorporated herein by reference in their entireties.

The invention relates to drillships, or so-called monohull offshore drillships, especially offshore drillships.

Over 50 years, monohull drillships are used in drilling, especially for exploratory or development offshore drilling of oil wells, gas wells and/or other wells, and/or for mining operations, e.g. for commercial and/or scientific drilling purposes. Due to their own propulsion means and due to the ship-shaped and streamlined design of the hulls of drillships, which have a length-beam ratio of 4 or more, a drillship can be moved relatively easily in comparison to semi-submersibles, jackup rigs, and barges, which enables them to be moved relatively quickly and/or relatively cheaply from one drilling location to another drilling location, which can save precious time sailing between oilfields or gasfields worldwide.

Known drillships are normally provided with a so-called moon pool, especially an open moon pool, located at the level of the waterline during use of the drillship, i.e. at least during drilling operations. The moon pool defines an opening in the base of the hull of the ship through which drilling equipment can pass.

Originally, moon pools are normally of substantially square design and a well centre or so-called drill centre is provided at the centre of the moon pool. Thereto, the drillship comprising the moon pool is generally provided with a drilling rig or a so-called derrick, which can be formed as a tower, mast, structure and/or framework, that can hold rig equipment, which can form a drilling system or so-called rig system. Said rig equipment may be arranged for example for hoisting, rotating, handling and/or transferring pipes and other drilling equipment. For instance thereto, said rig equipment may for instance include drawworks, a top drive, a pipe handling system and other rig equipment.

Further, a generation of dual activity drillships have been developed which have a longitudinally extending elongated moon pool in stead of a substantially square moon pool, wherein the elongated moon pool is provided with two well centres that are located in front of each other on the longitudinal centre line of the ship. Both of said well centres are provided with an independently working rig system or so-called drilling system, wherein each rig system comprises its own rig equipment for drilling operations. Normally, both rig systems are held by the same derrick. Drillships having two well centres in front of each other allow so-called dual activity drilling, i.e. allow to perform multiple drilling operations concurrently, such as for instance simultaneous drilling and riser or casing handling, instead of performing them sequentially. One of the well centres forms a main well centre at which the primary drilling activity, i.e. the actual well drilling, takes place and is equipped with a full capacity drilling system. The second well centre is an auxiliary well centre, which is arranged for secondary activities, such as riser or casing handling, but has less capacity than the main well centre. For example, the capacity of the static hook load, the drawworks, and/or the top drive of the auxiliary well centre may be only 40%-80% of that of the main well centre. Dual activity drilling can provide significant advantages over using a drillship with a single moon pool with a single rig system, e.g. by saving costly time at a drilling location. However, using drillships having two well centres is relatively complex, e.g. because the auxiliary well centre can block access to the main well centre, and such drillships are logistically relatively problematic in comparison to drillships having just a single well centre.

The present invention aims at providing an alternative monohull drillship. It is an object of the present invention to alleviate or solve at least one disadvantage of known monohull drillships. In particular, the invention aims at providing a monohull drillship which allows multiple drilling operations to be performed at least partly simultaneously and which at the same time can counteract logistic problems of the known dual activity drillships at least partly.

In a first aspect of the invention, the present invention provides for a monohull drillship which comprises an elongated hull extending in the length direction of the drillship, said hull being provided with at least one open moon pool arranged to be located at the waterline during use of the drillship, e.g. at least during drilling operations, wherein the drillship is arranged for multiple-activity operations or so-called multiple-activity drilling, e.g. simultaneous drilling and casing handling, in such a manner that drilling equipment can be passed through said at least one moon pool at at least two locations, i.e. at at least two so-called well centres or so-called drill centres, which are spaced apart from each other in at least a direction substantially transverse to the length direction of the hull of the drillship.

By providing the two well centres such that they are spaced apart from each other in at least the width direction of the drillship, drilling equipment may be supplied to each one of said well centres from a foredeck and also from an afterdeck. Furthermore, such an arrangement allows moving certain drilling equipment, such as casing, from a foredeck to an afterdeck (or vice versa) via one of the well centres, while in the meantime the other well centre can be used to perform drilling operations. In case drilling equipment is desired at another deck than at the deck at which it currently is located, said equipment can be moved relatively easily to the other deck, i.e. without the need of interrupting drilling operations at both well centres such as occurs in known dual activity drillships when drilling equipment is to be moved from an afterdeck to a foredeck or vice versa. Hence, the inventive arrangement of the well centres of the drillship of the present invention is logistically advantageous in comparison to conventional dual activity drillships having two well centres in front of each other located at the longitudinal centre line of the ship.

Contrary to the general opinion that the single well centre, or both well centres, should be provided at the longitudinal centre line of a drillship, the present invention places at least one well centre and preferably two well centres off centre, i.e. laterally aside of the longitudinal centre line of the drillship. Tests have shown that drilling actions at a well centre placed aside to some extent from the longitudinal centre line are not substantially more hindered by rolling of the ship, i.e. pivoting side to side, about a substantially horizontal longitudinal axis, than drilling actions at a well centre placed substantially at the longitudinal centre line of a drillship.

Although the general opinion is that two well centres for enabling dual activity drilling should be placed behind each other in the length direction of the drillship and should be centrally aligned with the longitudinal centre line of the drillship, it is surprisingly found that placing at least one and preferably two of the well centres off centre, more preferably both at another side of the centre line of the drillship, especially both at substantially the same distance off centre, does at the one hand not cause the imagined technical problems, such as for instance the imagined increased instability, which kept the skilled person from even considering carrying out experiments to determine whether or not an elongated moon pool having multiple well centres could be placed differently, e.g. transversely, where it at the other hand does provide advantages over the conventional general standard dual activity drilling drillship configuration, such as the improved accessibility of both well centres.

Moreover, by arranging at least two of the at least two well centres as a main well centre, i.e. two or more well centres having rig equipment with the same minimal capacity, e.g. said two or more well centres having substantially the same capacity, the primary drilling activities can be transferred to the second or a further main well centre in case of failure the activities of the first main well centre. Since said two or more main well centres are spaced apart from each other in at least the width direction of the drillship, they may be relatively easily supplied from the fore deck and from the afterdeck. Hence, it can be facilitated relatively well that a second or further main well centre can take over tasks of the first main well centre in case of failure thereof.

In a further aspect, the present disclosure relates to a monohull drillship which comprises an elongated hull extending in the length direction of the drillship, said hull being provided with an open moon pool which is arranged to be located at the waterline during use of the drillship, wherein the moon pool is of elongated design and the drillship is arranged for multiple activity operations or so-called multiple activity drilling in such a manner that drilling equipment can be passed through said elongated moon pool at at least two locations, i.e. so-called well centres, which are spaced apart from each other in at least the length direction of the elongated moon pool, wherein said length direction of said elongated moon pool extends in a direction substantially transverse to the length direction of the hull of the drillship.

Tests have shown that positioning an open moon pool of elongated design in a substantially transverse direction of the drillship, in stead of aligning it in the length direction of the ship, produces the effect that moon pool sloshing can be reduced, while it can still allow dual activity drilling.

Moreover, by providing the two well centres such that they are spaced apart from each other in at least the length direction of the substantially transversely extending elongated moon pool, drilling equipment can be supplied to one of said well centres from a foredeck and also from an afterdeck. Furthermore, such an arrangement allows moving certain drilling equipment, such as casing, from a foredeck to an afterdeck (or vice versa) via one of the well centres, while in the meantime the other well centre can be used to perform drilling operations.

Although the general opinion is that an elongated moon pool provided with two well centres for enabling dual activity drilling should be placed in the length direction of the drillship and should be centrally aligned with the longitudinal centre line of the drillship, it is surprisingly found that placing the elongated moon pool in a direction substantially transverse to the length direction of the monohull offshore drillship and placing at least one and preferably two of the well centres off centre, more preferably both at another side of the centre line of the drillship, especially both at substantially the same distance off centre, does at the one hand not cause the imagined technical problems, such as for instance the imagined increased instability, the imagined lack of space for turning the moon pool and/or the imagined lack of structural integrity to a hull with a substantially transverse moon pool, which kept the skilled person from even considering carrying out experiments to determine whether or not an elongated moon pool having multiple well centres could be placed differently, e.g. transversely, where it at the other hand does provide advantages over the conventional general standard dual activity drilling drillship configuration, such as the improved accessibility of both well centres and the reduced moon pool sloshing during sailing.

Advantageous embodiments according to the invention are described in the appended claims.

By way of non-limiting examples only, embodiments of the present invention will now be described with reference to the accompanying figures in which.

It is noted that the figures show merely preferred embodiments according to the invention. In the figures, the same or similar reference signs or numbers refer to equal or corresponding parts.

FIGS. 1-4 show embodiments of a monohull drillship 1 according to the present invention, which preferably can be a monohull offshore drillship. The drillship 1 comprises an elongated hull 2 which extends in the length direction 3 of the drillship 1. It is noted that the length direction 3 of the drillship 1, which can be understood as a direction 3 extending from the front side of the drillship 1 to the rear side of the drillship, or vice versa, can extend substantially horizontally, especially in a state in which the drillship 1 is substantially at rest, e.g. is not substantially pitching, i.e. not rotating about its transverse axis.

Figure 1:
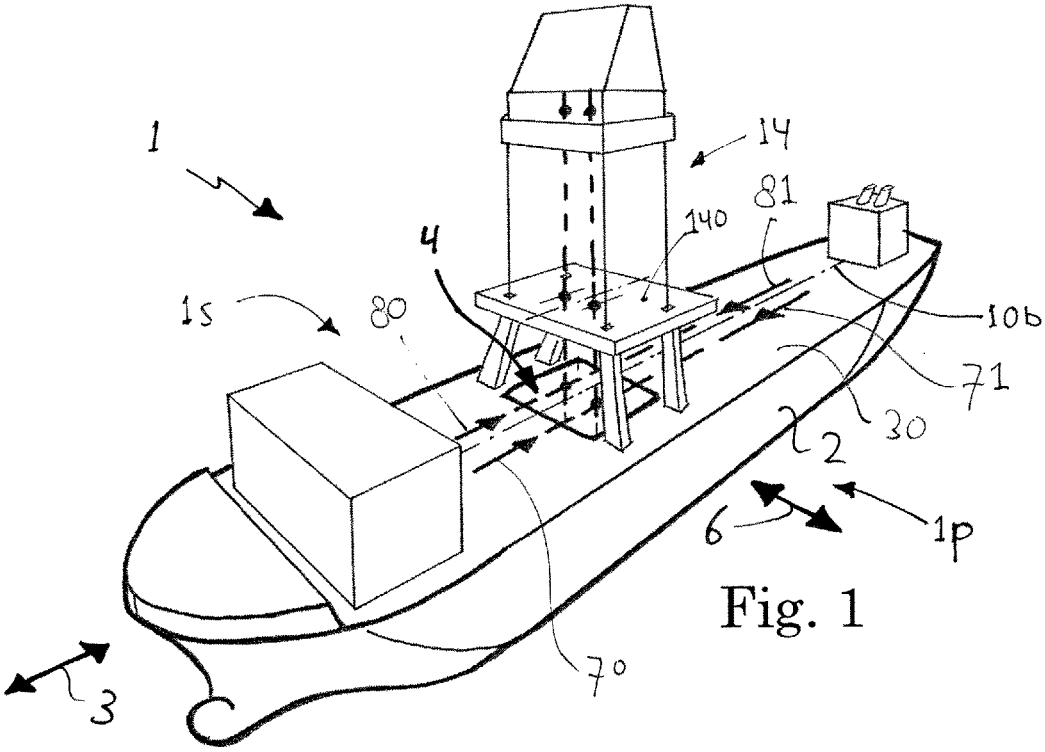
FIG. 1 shows a schematic perspective view of a first embodiment of a monohull drillship according to an aspect of the invention.
Figure 2:
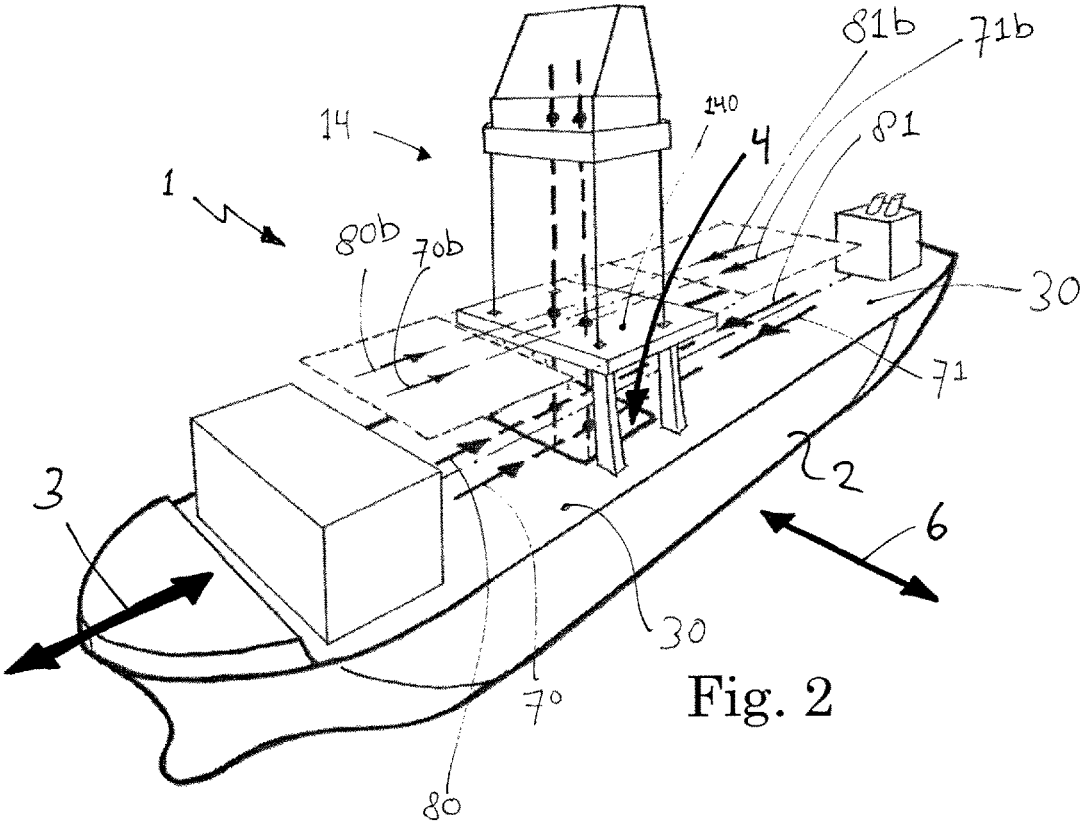
FIG. 2 shows a schematic perspective view of a second embodiment of a monohull drillship according to an aspect of the invention.

In the shown embodiments, the hull 2 of the monohull drillship 1 is a streamlined hull 2, which means that the drillship 1 has a ship-shaped design, as can be seen relatively well in FIGS. 1 and 2. The ship 1 can have a length-beam ratio of 4 or more. The hull can thus have a relatively slim, streamlined design, which can facilitate a relative efficient transit performance and/or a relatively good motion behaviour. It is noted that the drillship 1 can be a self-propelled drillship 1, e.g. comprising at least a main propulsion engine and/or comprising multiple individual thrusters.

The hull 2 of the drillship 1 is provided with an open moon pool 4 which is arranged such as to be located at the waterline 5 during use of the drillship 1, i.e. at least during drilling activity. It is noted that an open moon pool can be understood as a moon pool 4 located at the water level, which moon pool 4 has a moon pool part 4*a* (see FIG. 4), e.g. a room 4*a*, located above the waterline 5, which is at least partly open to the air 13 outside the drillship 1. Although the ship 1 of the shown embodiments comprises a single moon pool 4, it is noted that the drillship 1 may comprise multiple moon pools 4 in alternative embodiments.

Figure 3:
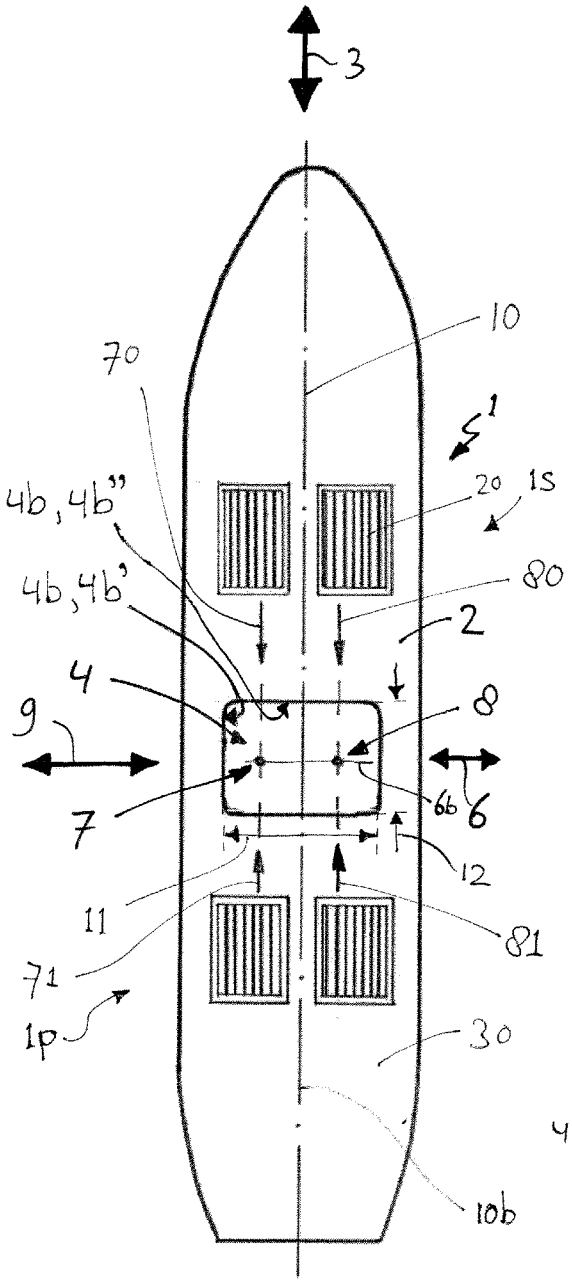
FIG. 3 shows a schematic top view of a third embodiment of a monohull drillship according to an aspect of the invention.

The open moon pool 4, which is arranged to be located at the waterline 5 during use of the drillship 1, can be defined at least partly by means of side walls 4*b* (see FIG. 3)

extending from lower wall ends thereof, which are located below the waterline 5, in an upward direction towards higher wall ends thereof located above the waterline 5. In preferred embodiments, the side walls 4*b*, or at least a part thereof located at the waterline level, can extend substantially in a substantially vertical direction.

As can be seen in the shown exemplary embodiments, the elongated moon pool 4 can for instance be of substantially rectangular or square design and can have four side walls 4*b*, e.g. two side walls 4*b*' located at the sides and two side walls 4*b*" located the front and the rear side of the moon pool 4, respectively. Nevertheless, in embodiments, the moon pool or moon pools can have any suitable shape, e.g. a shape being substantially oval, round, T-shaped, L-shaped, etc.

Advantageously, the moon pool 4 can be of elongated design, especially of rectangular design. It is noted that the elongated design may be understood as a design having a length 11 that is substantially longer than the width 12, e.g. the length 11 being at least 20%, or at least 25%, longer than the width 12. For example, a ratio between the length 11 of the elongated moon pool 4, which length 11 extends substantially in the width direction of the drillship 1, and the width 12 of the moon pool 4, which width 12 extends substantially in the length direction 3 of the drillship 1, can be a least 9:7, preferably at least 7:5, such for instance about 3:2, about 5:3 or about 2:1 or even about 5:2.

Further, it is noted that the drillship 1 is arranged for multiple activity operations or so-called multiple activity drilling in such a manner that drilling equipment 20, e.g. drill pipes 20 of a drill string or drill stand, can be passed through said elongated moon pool 4 at at least two locations 7, 8, i.e. at at least two so-called well centres 7, 8 or so-called drill centres 7, 8, which are spaced apart from each other in at least a direction substantially transverse to the length direction of the hull of the drillship 1.

Advantageously, e.g. in case of transversely extending moon pool, said two locations or so-called well centres, can be spaced apart from each other in at least the length direction 6 of such elongated moon pool 4.

During use of the drillship 1, for example, a first one of the well centres can be used as a main well centre, e.g. a well centre at which is drilled, and a second one of the well centres 7, 8 can be used as an auxiliary well centre, e.g. a well centre where a relatively long string of pipes, e.g. riser pipes, is being assembled, for instance a string of which a top part is extending through the moon pool 4 and a lower part is extending in the water below the drillship 1. In embodiments, the drillship 1 may be arranged for dual activity operations or so-called dual activity drilling.

One of the well centres may form a main well centre at which during use the primary drilling activity, i.e. the actual well drilling, can take place and said well centre can then be equipped with a full capacity drilling system. The second well centre and/or any further well centre may the form an auxiliary well centre, which can then be arranged for secondary activities, such as riser or casing handling, but which may have rig equipment with less capacity than the main well centre. For example, the capacity of the static hook load, the drawworks, and/or the top drive of the auxiliary well centre may be only 40%-80% of that of the main well centre.

Nevertheless, in preferred embodiments of the present invention, at least two of the at least two well centres may be arranged as a main well centre. The rig equipment of each of the at least two main well centres, which may for instance include drawworks, a top drive, a pipe handling system and other rig equipment, may thus be arranged for performing main drilling activities. Hence, when a well centre used as the main well centres drops out and/or is to be maintained, one or the other well centre can be used as a main well centre.

Although moon pool 4 may be elongated and although the length direction 6 of such elongated moon pool 4 can preferably extend in a direction 9 substantially transverse to the length direction 3 of the hull 2 of the drillship 1, the moon pool 4 may be of different design and/or may be located in an alternative manner. Preferably, the length direction 6 of an elongated moon pool 4 can be perpendicular to the direction 3 of the hull 2. However, in alternative embodiments, the direction 9 in which the length direction 6 of a substantially transversely placed moon pool 4 extends can be at a slight angle relative to the transverse axis of the drillship 1, e.g. an angle of at most 15°, preferably an angle of at most 12°, 10°, 8°, or 5°, such as for instance at most or about 4°, 2°, or 1°.

In order to keep the drillship 1 in position during drilling activities, the drillship 1 can be outfitted with a dynamic positioning system, and preferably multiple thrusters, and/or mooring equipment, e.g. comprising multiple anchors, such that the drillship 1 can maintain position over a well, e.g. by positioning the first and/or the second well centre 7, 8 substantially above a respective well.

It is known that a moon pool located at the waterline 5 causes additional resistance when a drillship sails in comparison to a similar sized ship lacking moon pool. However, in advantageous embodiments of the present disclosure, the substantially transverse configuration of the moon pool 4 can result in a moon pool that extends over a relatively small distance 12 in the length direction 3 of the ship 1. Although such substantially transverse moon pool configuration may also result in that the moon pool 4 extends over a relatively large distance 11 in the width direction of the drillship, such substantially transverse moon pool configuration surprisingly is found to cause less resistance to a sailing drillship than a longitudinally oriented elongated moon pool of the same size would do to a drillship with substantially similar dimensions.

With respect to the length direction 6 of the moon pool 4 it is noted that said length direction 6 can extend and/or can be measured substantially horizontally. The length direction 6 of the moon pool 4 can thus extend substantially from the port side 1*p* of the drillship 1 to the starboard side 1*s* of the drillship 1.

In a preferred embodiment, at least two of the at least two well centres 7, 8, and preferably all, e.g. both, of the at least two well centres, are spaced from each other substantially only in the width direction of the drillship 1 and/or in the length direction 6 of the elongated moon pool 4. This is, the at least two of the at least two well centres 7, 8, and preferably all well centres, are then located substantially aside of each other, i.e. located substantially on a virtual line 6*b* extending substantially transverse to the length direction 3 of the drillship 1 and/or located substantially on a line 6*b* extending substantially transverse to a virtual vertical centre plane 10 of the hull 2 running through said hull 2 in the length direction 3 of the drillship 1. Advantageously, said virtual line 6*b* extending substantially transverse to the length direction 3 of the drillship 1 can be located substantially halfway between the front wall of the moon pool 4 and the rear wall of the moon pool, such that can be counteracted relatively well that equipment fed through the moon pool 4 will accidentally abut with such moon pool wall 4*b*".

Hence, seen in the length direction 3 of the drillship 1, a first one 7 of the at least two well centres 7, 8 is not located substantially further forward (or substantially further backward) than a second one 8 of the at least two well centres 7, 8.

It is noted that, seen from the central longitudinal axis of the drillship 1, the moon pool 4 may preferably extend substantially the same distance to the starboard side 1*s* of the drillship as to the port side 1*p* of the drillship. In preferred embodiments in which two well centres 7, 8 are located substantially aside of each other, a first one 7 of said well centres may be located substantially halfway the distance between said longitudinal axis and the port side side wall 4*b*' of the moon pool 4, whereas the other one 8 of the two well centres may be located substantially halfway the distance between said longitudinal axis and the starboard side side wall of the moon pool 4. However, the distances between said moon pool side walls 4*b*' and the respective adjacent well centre and the intermediate distance between both well centres 7, 8 may be chosen differently. For example, it may be advantageous to choose these three distances such that they substantially have the same lengths.

In preferred embodiments of cases in which more than two well centres 7, 8 are located at said moon pool 4, preferably none of said more than two well centres is located substantially further forward (or backward) than any other one of said multiple number of well centres. This is, preferably all well centres located at the moon pool 4 are located substantially aside of each other, i.e. located substantially on a line 6*b* extending substantially transverse to the length direction 3 of the drillship 1.

Although the drillship 1 can preferably comprise a single moon pool for drilling activities, the drillship may in embodiments be provided with multiple moon pools for drilling activities.

Although at least two of the at least two well centres can preferably be located at a common moon pool 4, i.e. at a single moon pool or at a same one of multiple moon pool, said at least two of the at least two well centres may alternatively be located at different moon pools, e.g. each at its own moon pool. Alternatively, multiple well centres may be provided in a single moon pool in which a partition or dividing wall can be provided.

As can be seen in the figures, a first one 7 of the at least two well centres can preferably be located on the port side 1*p* of the drillship and a second one 8 of said well centres can preferably be located on the starboard side 1*s* of the drillship 1. More preferably, a lateral distance over which the first well centre 7 is spaced away from a virtual longitudinal vertical centre plane 10 of the ship hull 2 is substantially equal to a second lateral distance over which the second well centre 8 is spaced away from said centre plane 10.

In embodiments, more than two well centres can be provided at the drillship 1, preferably at a single moon pool 4, especially a single substantially transversely extending elongated moon pool 4. For example, in cases in which three well centres are provided at the ship, especially at a single moon pool 4, a third well centre can preferably be located substantially midway between the first and the second well centre 7, 8, e.g. substantially at a location where the line 6*b*, on which the first well centre 7 and second well centre 8 are located, intersects with the longitudinal centre line 10*b* of the drillship 1.

With respect to the preferred elongated design of the moon pool 4, it is noted that the length 11 of the moon pool 4, which then is substantially longer than the width 12 of the moon pool, and said width 12 can preferably be measured at a horizontal cross-section of the moon pool, for instance substantially at the waterline 5 level. In embodiments, a ratio between the length 11 of the horizontal cross-section, which length 11 then extends substantially in the width direction of the drillship 1, and the width 12 of the horizontal cross-section, which width 12 then extends substantially in the length direction 3 of the ship 1, can be a least 9:7, preferably at least 7:5, such for instance about 3:2, about 5:3 or about 2:1 or even about 5:2.

In embodiments, the width 12 of the horizontal cross-section can be at least 7 meters, preferably at least 8 meters, more preferably at least 9 meters. For example, said width 12 can be about 10, 11, 12, 13, 14, or 15 meters.

By keeping the width 12, which thus can extend substantially in the length direction 3 of the ship 1, relatively small, moon pool sloshing can be kept relatively limited in size. For example, the width 12 of the horizontal cross-section can be at most 18 meters, preferably at most 17 or 16 meters, more preferably at most 15 meters, such as for instance about 14, 13, 12, 11, or 10 meters.

Additionally or alternatively, the length 11 of the horizontal cross-section, which length 11 extends substantially in the width direction of the drillship 1, can be at least 12 meters, preferably at least 13, 14, 15, 16 or 17 meters, such as for instance about 18, 19, 20, 21, 22 meters, or even about 23, 24, 25, 26, 27 or 28 meters. Hence, enough space may be provided to provide at least two well centres 7, 8 spaced apart from each other in the length direction 6 of the elongated moon pool 4 and to space both of said two well centres far enough from the respective side wall 4*b*' at the side 1*p*, 1*s* of the drillship 1.

In embodiments of a drillship with an elongated moon pool, the length 11 of the horizontal cross-section can be chosen such as to be at most 35 meters, preferably at most 32, 30 or 28 meters, such as for instance about 26, 24, 22 or 20 meters.

Figure 4:
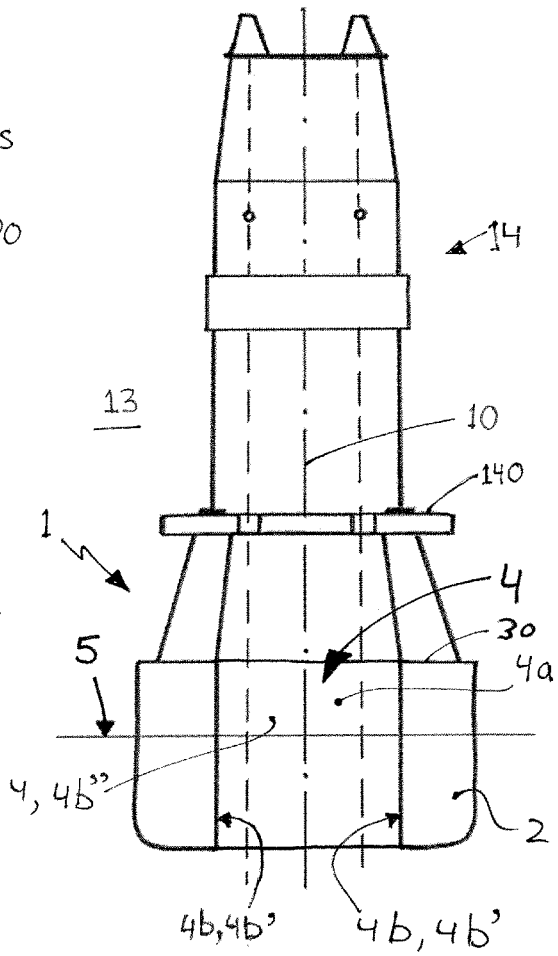
FIG. 4 shows a schematic lateral cross-sectional view of a fourth embodiment of a monohull drillship according to an aspect of the invention.

As can be seen in FIGS. 1, 2 and 4, the drillship 1 can preferably be provided with a derrick 14 arranged for multiple, e.g. dual, activity operations or a so-called multiple, e.g. dual, activity rig 14. Alternatively, multiple derricks or rigs, e.g. two derricks or rigs, may be provided, a first one of which can be arranged to hold rig equipment, e.g. forming a rig system or so-called drilling system, at the first well centre 7 and a second one of which can be arranged to hold rig equipment, e.g. forming a rig system or so-called drilling system, at the second well centre 8. In a preferred case of a single derrick 14 or multiple activity rig 14, said derrick can be provided with two substantially separate rig systems or drilling systems, each for enabling drilling activity at a respective one of the well centres 7, 8.

It is noted that the derrick or rig can substantially be formed by or as a tower, a mast, e.g. a so-called mast type derrick, a structure and/or a framework, that can hold and/or handle rig equipment.

Advantageously, a single derrick 14 arranged for dual or other multiple activity operations can have a horizontal cross-section of elongated shape, wherein the length direction of said elongated shape can substantially extend in a direction substantially transverse to the length direction 3 of the drillship 1.

It is noted that the derrick 14, or derricks 14, can be provided substantially above the moonpool 4.

In preferred embodiments, the drillship 1 may be provided with at least two feeding systems 70, 71 for feeding drilling equipment to the first well centre 7, e.g. feeding systems for feeding tubulars. Embodiments of such feeding systems 70, 71 are schematically shown in the figures by means of arrows 70, 71. For example, a first one 70 of said two feeding systems, may be arranged to supply drilling equipment 20 from a foredeck to the first well centre 7 and/or to transfer drilling equipment 20, e.g. drilling pipes 20 or riser pipes, from the first well centre 7 to the foredeck. The second one 71 of said two feeding systems can then preferably be arranged to supply drilling equipment 20 from an afterdeck to the first well centre 7 and/or to transfer drilling equipment, e.g. drilling pipes or riser pipes, from the first well centre 7 to said afterdeck.

Additionally or alternatively, the drillship 1 may be provided with at least two feeding systems 80, 81 for feeding drilling equipment 20 to the second well centre 8, e.g. feeding systems for feeding tubulars, which feeding systems 80, 81 are schematically shown in the figures by means of arrows 80, 81. For example, a first one 80 of said two feeding systems, may be arranged to supply drilling equipment 20 from a foredeck to the second well centre 8 and/or to transfer drilling equipment 20, e.g. drilling pipes 20 or riser pipes, from said second well centre 8 to said foredeck. The second one 81 of said two feeding systems for feeding the second well centre 8 can then preferably be arranged to supply drilling equipment 20 from an afterdeck to the second well centre 8 and/or to transfer drilling equipment 20, e.g. drilling pipes or riser pipes, from the second well centre 8 to said afterdeck.

Hence, the monohull offshore drillship 1 may thus be arranged to feed drilling equipment 20, e.g. a casing stand or a drill pipe stand, to the first well centre 7 and/or the second well centre 8 from both a foredeck and from an afterdeck as well. This may counteract a lot of logistic problems.

Preferably, at least one, and more preferably each, of the above mentioned feeding systems 70, 71, 80, 81, can be arranged to feed drilling equipment 20 to, and/or to convey drilling equipment 20 away from, the respective well centre 7, 8 in a direction substantially parallel to the length direction 3 of the drillship 1.

Alternatively or additionally, the drillship 1 may be provided with a feeding system, e.g. a tubular feeding system, arranged for supplying at least two, and preferably all, of the at least two well centres from a fore deck, and/or a feeding system for supplying at least two, and preferably all, of the at least two well centres from an afterdeck. For example, a feeding system for multiple well centres may be provided having a distal end portion at which equipment, e.g. drilling pipes or riser pipes etc., can be delivered to a well centre, wherein at least said distal end portion is movable such that said distal end portion of the feeding system can be moved from a first to a second well centre or vice versa. Alternatively, the feeding system may comprise multiple distal end portion for delivering equipment to a well centre, wherein the feeding system for instance can comprise an adjustable switch enabling to control to which well centre the equipment is fed by said feeding system.

Advantageously, a feeding system 70, 80 for feeding drilling equipment 20 from a foredeck towards the respective well centre 7, 8 can be located substantially in a substantially vertically extending virtual plane extending substantially in the longitudinal direction 3 of the drillship 1, and a feeding system 71, 81 for feeding the same well centre 7, 8 from the afterdeck can then be located substantially in the same substantially longitudinally extending virtual plane. Preferably, a first feeding system 70, 80 for feeding drilling equipment 20 from the front and a second feeding system 71, 81 for feeding drilling equipment from the back to the same well centre 7, 8 can be substantially aligned with each other. Hence, it can be facilitated relatively easily to move drilling equipment 20 from a foredeck to a afterdeck or vice versa.

In a preferred embodiment, the feeding systems 70, 71, 80, 81 are arranged to supply drilling equipment to the drilling floor 140 at the drilling floor level.

In embodiments, one or multiple additionally feeding systems 70*b*, 80*b*, 71*b*, 81*b* can be provided, e.g. at a level above or below the level where one or multiple the above mentioned feeding systems 70, 80, 71, 81 are provided. As can be seen in FIG. 2, main feeding systems 70, 80, 71, 81 can for instance be provided to feed drilling equipment 20 towards the respective well centre 7, 8 at a first level, e.g. at the level of a main deck 30, whereas one or multiple additionally feeding systems 70*b*, 80*b*, 71*b*, 81*b* can be provided for feeding drilling equipment 20, such as drilling pipes, to the same respective well centre 7, 8 at a higher level, e.g. substantially at the level of the rig floor 140 or so-called drilling floor 140.

Advantageously, in a preferred embodiment, main feeding systems may be provided at the drilling floor level, e.g. above the main deck 30. Although secondary feeding systems may preferably be provided, e.g. at the level of the main deck 30, such secondary feeding systems may also be omitted. This is, in the embodiment shown in FIG. 2, the feeding systems 70*b*, 80*b*, 71*b*, 81*b* can then for instance form the main feeding systems, whereas the lower feeding systems 70, 80, 71, 81, which can be located substantially at main deck level, can form additional feeding systems, or can even be omitted.

Additionally or alternately, additional feeding systems may be provided at a level below the main deck 30, e.g. in order to feed subsea related equipment, such as but not limited to subsea blowout preventers (BOPs), Xmas trees or so-called Christmas trees, etc., to the moon pool area, especially to the respective well centre 7, 8. Advantageously, said additionally feeding systems can be provided at a front and/or rear side of the moon pool 4.

Additionally or alternatively, one or multiple feeding systems may be provided to feed equipment to a well centre from aside. Such side feeding system may for instance be provided at the starboard side and/or at the port side of the moon pool and/or substantially at the level of the main deck 30, the level of the rig floor 140, and/or a level below the main deck.

It is noted that for the purpose of clarity and a concise description features are described herein as part of the same or separate embodiments, however, it will be appreciated that the scope of the invention may include embodiments having combinations of all or some of the features described.

Further, it is noted that the invention is not restricted to the embodiments described herein. It will be understood that many variants are possible.

Fore example, the drillship may be arranged for triple activity operations, for instance wherein primary activities take place in a central well centre and secondary activities take place in a starboard well centre and a port well centre.

Such and other variants will be apparent for the person skilled in the art and are considered to lie within in the scope of the invention as formulated in the following claims.

The invention claimed is:

1. A monohull drillship, comprising:

an elongated hull extending in a length direction of the drillship, said hull being provided with at least one open moon pool arranged to be located at the waterline during use of the drillship, wherein the drillship is arranged for multiple-activity operations or multiple-activity drilling, in such a manner that drilling equipment can be passed through said at least one moon pool at at least two well centers or drill centers, which are spaced apart from each other in at least a direction substantially transverse to the length direction of the hull of the drillship, wherein at least two of the at least two well centers are located at a common moon pool, wherein the common moon pool is a single moon pool or a same one of multiple moon pools, wherein the common moon pool has an elongated design wherein a length direction of the common moon pool is larger than a width direction thereof, and wherein the length direction of the elongated common moon pool is extending in a direction substantially transverse to the length direction of the hull of the drillship.

2. The drillship according to claim 1, wherein the hull of the monohull drillship is a streamlined hull and/or has a ship-shaped design.

3. The drillship according to claim 1, wherein the length-beam ratio of the ship is at least 4.

4. The drillship according to claim 1, wherein at least two of the at least two well centers are arranged as a main well center.

5. The drillship according to claim 1, wherein at least two of the at least two well centers are spaced from each other substantially only in said direction substantially transverse to the length direction of the hull of the drillship.

6. The drillship according to claim 1, wherein a first one of said well centers is located on the port side of the drillship and a second one of said well centers is located on the starboard side of the drillship, wherein a lateral distance over which the first well center is spaced away from a virtual longitudinal vertical center plane is substantially equal to a second lateral distance over which the second well center is spaced away from said center plane.

7. The drillship according to claim 1, wherein the at least two well centers are spaced from each other in at least the length direction of said elongated common moon pool.

8. The drillship according claim 1, wherein the elongated common moon pool has a horizontal cross-section, substantially at the waterline level, which horizontal cross-section has a substantially rectangular shape.

9. The drillship according to claim 8, wherein a ratio between the length of the horizontal cross-section, which length extends substantially in the width direction of the drillship, and the width of the horizontal cross-section, which width extends substantially in the length direction of the ship, is a least 9:7.

10. The drillship according to claim 1, wherein the at least one open moon pool, which is arranged to be located at the waterline during use of the drillship, is defined at least partly by means of side walls extending from lower wall ends thereof, which are configured to be located below the waterline during use of the drillship, in an upward direction towards higher wall ends thereof, which are configured to be located above the waterline during use of the drillship.

11. The drillship according to claim 1, wherein the drillship is provided with a derrick arranged for multiple-activity operations or a multiple-activity rig.

12. The drillship according to claim 1, wherein the drillship is a self-propelled drillship comprising at least a main propulsion engine and/or comprising multiple individual thrusters.

13. The drillship according to claim 1, wherein the drillship is provided with at least two feeding systems for feeding drilling equipment to the first well center, wherein a first one of said feeding systems is located in front of the first well center and a second one of said feeding systems is located at a rear side of the first well center, and/or wherein the drillship is provided with at least two feeding systems for feeding drilling equipment to the second well center, wherein a first one of said feeding systems is located in front of the second well center and a second one of said feeding systems is located at a rear side of the second well center.

14. The drillship according to claim 1, comprising:

a feeding system for supplying at least two of the at least two well centers from a fore deck, and/or a feeding system for supplying at least two of the at least two well centers from an afterdeck.

15. The drillship according to claim 9, wherein the ratio between the length of the horizontal cross-section and the width of the horizontal cross-section is at least 7:5.

* * * * *